US006006921A

United States Patent [19]

Zehr

[11] Patent Number: 6,006,921

[45] Date of Patent: Dec. 28, 1999

[54] TRANSPORTABLE TROMMEL ASSEMBLY

[75] Inventor: Melvin A. Zehr, Middleton, Id.

[73] Assignee: Diamond Z Manufacturing Co., Inc., Nampa, Id.

[21] Appl. No.: 09/055,040

[22] Filed: Apr. 3, 1998

[51] Int. Cl.[6] ..... B07B 1/22

[52] U.S. Cl. ..... 209/288; 209/241; 209/242; 209/247; 209/244; 209/420; 209/421; 198/311

[58] Field of Search ..... 209/241, 242, 209/247, 420, 421, 244, 288; 198/311, 313, 314

[56] References Cited

U.S. PATENT DOCUMENTS

| | | | |
|---|---|---|---|
| 2,745,540 | 5/1956 | Smoker | 198/115 |
| 3,889,796 | 6/1975 | Bailey et al. | 198/7 |
| 4,303,506 | 12/1981 | Finlay | 209/421 |
| 4,591,432 | 5/1986 | Hartl | 209/247 |
| 4,813,526 | 3/1989 | Belanger | 198/313 |
| 4,981,204 | 1/1991 | Smith | 198/313 |
| 5,248,042 | 9/1993 | Kuhmonen | 209/288 |
| 5,819,950 | 10/1998 | McCloskey | 209/241 |

FOREIGN PATENT DOCUMENTS

| | | | |
|---|---|---|---|
| 236886 | 11/1964 | Austria | 209/421 |
| 1553667 | 10/1979 | United Kingdom | 209/421 |

*Primary Examiner*—Donald P. Walsh
*Assistant Examiner*—Daniel Schlak
*Attorney, Agent, or Firm*—Frank J. Dykas

[57] ABSTRACT

A transportable trommel assembly is provided with a frame, a cylindrical trommel screen, having an infeed end and a discharge end rotatably mounted to the frame, and conveyors for carrying away sized material from the trommel screen. An infeed conveyor is movably connected to the frame and positionable to an operating position for infeeding material into the infeed end of the trommel screen and to a transport position where it is held within the infeed end of the trommel screen.

17 Claims, 6 Drawing Sheets

TRANSPORTABLE TROMMEL ASSEMBLY

BACKGROUND OF THE INVENTION

1. Technical Field

This invention generally relates to trommel assemblies, and more particularly to a transportable trommel assembly wherein the infeed conveyor is attached to the trommel assembly and positionable to both transport and lowered operating positions.

2. Background

Trommels, as known in the prior art, are sizing machines which are used to size and segregate aggregate material such as crushed rock, coal or wood chips, and a wide variety of other materials, into different sized groupings. With a trommel, this is accomplished by passing the material to be sized through a rotating cylindrical screen of a particular screen size.

Simple trommels may have only one screen sieve size and accomplish a single sizing operation wherein the aggregate material that is small enough to pass through the screen is collected on to a moving conveyor underneath the rotating screen and conveyed away to one location, while the material that is too large to pass through the screen eventually works its way down to the discharge end of the screen and is deposited either on another discharge conveyor or simply dumped on the ground.

Two stage trommel screens have two separate sieve sizes for the rotating screen, with the smaller sieve size being located at the infeed end of the rotating screen, and a larger sieve sized screen located nearer the discharge end of the rotating screen. With two-stage trommel screen assemblies, fine materials are first collected at the infeed end of the rotating screen and conveyed off to one location. Larger material that will pass through the larger sieve size located at the discharge end of the rotating screen is collected by a second conveyor, and conveyed to a second location, and the material that will not pass through any of the screen is discharged at the end and either conveyed away or dropped on the ground.

In order for a trommel assembly to work, the infeed end of the rotating screen must be elevated so that material that is infed into the infeed end of the rotating trommel screen will, as it is agitated, work its way down parallel to the longitudinal axis of the screen to the discharge end. If the infeed end of the rotating screen was not elevated, the trommel screen would eventually fill with oversized material and cease to function.

In some applications, trommel assemblies can be more or less permanently located on site. Examples would include processing areas at coal mines and rock quarries. In these applications there is typically provided an infeed conveyor which is used to elevate the material to the infeed end of the trommel screen and drop it in. These infeed conveyors can be permanently mounted, and the mined or quarried material is brought to the trommel assembly for sizing and processing.

In other applications, the trommel assemblies must be portable. The reason for this is that there may not be enough material located at the site to be sized at any given time to facilitate continuous operation. Since trommel assemblies are often times large and very expensive pieces of machinery, it is not cost justifiable to leave, in situ, a trommel assembly which will only be operated one or two days a week or month. An example of this type of application is a logging operation where tree stumps and slash from the logging operation are collected and ground into wood chips using a rotating tub grinder, such as that described in U.S. Pat. No. 4,997,135. Once a particular area has been logged and the tree stumps and slash collected from the area, there will be no more material to be ground and removed, and any trommel assembly that has been used to segregate the material into various sizes will have to be moved to the next logging location.

In some logging operations, the ground wood chip material to be segregated by use of the trommel assembly is not generated at a rate sufficient to justify the full-time use of the trommel assembly, and as a result, the trommel assembly is periodically brought to the site, used for a few days, and then moved on to another site. In these situations, transportable trommels can be economically justifiable, since the segregated material can easily be segregated into fine material which is of high economic value and generally used as mulch for gardens and flower beds, and the intermediate size material can be used as a fuel for power generation, or further processed into wood pellets for use in home heating. And finally, the oversized material can be reprocessed through a rotating tub grinder, so that all of the tree stumps and slash from the logging operation can be fully utilized as a value added product in one form or another.

The problem in the prior art is the time it takes to transport the trommel assembly and set it up for use. For example, in use with logging operations to generate segregated, sized wood chip material, the trommel assembly is transported by a convoy of trucks. One truck transports the trommel, the second transports the infeed conveyor, and a third transports a front end loader or other piece of industrial machinery which is used to load the material to be segregated onto the infeed conveyor, and also the segregated, sized material into trucks for transport from the site. If the infeed conveyor is a separate piece of machinery, it must be attached in some form to the trommel assembly, and this process can take several hours, even for a skilled crew. Thus, in the prior art, an operator would need an extra truck to transport the infeed conveyor, and extra time to set up the entire assembly for operation.

A prior art alternative is to eliminate the infeed conveyor altogether, and instead just provide for a permanent, fixed loading chute at the input end of the trommel screen. The problem with this arrangement is that the infeed end of the trommel screen must be elevated in order for the trommel to work effectively. Thus, a prior art infeed chute is generally located twelve to sixteen feet in the air, thus requiring the use of a larger front end loader capable of elevating its dump bucket far into the air. Not only does this increase the machinery requirements by requiring a larger front end loader, but it also reduces the cycle time of the front end loader, since it has to lift the material higher into the air in order to dump it into the infeed end of the trommel screen.

Accordingly, what is needed is a transportable trommel screen assembly where the infeed conveyor is formed as an integral part of the assembly, and positionable to a transport position which is within transportable trailer length restrictions, and can be quickly set up by repositioning it to a lowered operating position, such that there is a lower lift required of the operator of the front end loader or other loading machine.

DISCLOSURE OF INVENTION

These objects are achieved in a transportable trommel assembly which has a frame to which is mounted a rotatable trommel screen assembly formed of longitudinal rails and a series of spaced frame hoops to which is attached a cylindrical trommel screen. Attached to the frame are wheel and axle assemblies, an engine unit, a pair of rear stabilizer jacks, as well as a pair of front elevational jacks. Also provided is a conveyor for collecting material from beneath the rotating trommel screen, and at least one discharge conveyor for depositing sieved and separated material at a specific location.

An infeed conveyor assembly is provided which is movable from a transport position to a lowered operating position. In the transport position, the infeed conveyor assembly is in an elevated position where the discharge end of the infeed conveyor extends into and is held, cantilevered, within the input end of the trommel screen, and the infeed end of the conveyor assembly is positioned such that a trailer hitch is located in the position where it can be connected to a transport vehicle.

The infeed conveyor system is attached to the frame assembly by means of two pairs of pivot arms and frame extensions which connect to a pair of opposing infeed conveyor frame rails. The attachment point for the infeed conveyor assembly is a pair of opposing frame rail pivot pins which connect the infeed conveyor rails to a pair of extension pivot arms which are positionable in a fully retracted position for positioning the infeed conveyor assembly in the transport position, and extendable through an intermediate position to a fully extended position. The extension pivot arms are attached to a pair of opposing lowering pivot arms by means of second pivot pins. The lowering pivot arms are interconnected to each other by means of a bottom plate from which extends a trailer hitch which is used to connect the transportable trommel assembly to a transport truck. The frame rails are not otherwise connected to the trommel frame assembly, other than that the frame rails rest and ride atop an infeed conveyor roller which is supported by means of a roller and guide bar frame. Also attached to the roller and guide bar frame are infeed conveyor side guide bars which align and hold the frame rails in all positions. In the transport position, the infeed conveyor assembly is held in a cantilevered fashion within the trommel screen assembly by means of the roller.

The pair of lowering pivot arms provide a lowering function. The lowering pivot arms are pivotally attached to frame extensions by means of a pair of pivot pins and attached to the extension pivot arms. Once the extension pivot arms have been fully extended, the lowering pivot arms are operable to lower the infeed end of the infeed conveyor assembly to a lowered position where the material to be sieved and separated can be deposited into a loading chute provided with the infeed conveyor assembly, and thereby elevated by the conveyor assembly to a position where it can be dumped into the infeed end of the rotating trommel screen.

DETAILED DESCRIPTION OF THE PREFERRED EMBODIMENT

Figure 1:
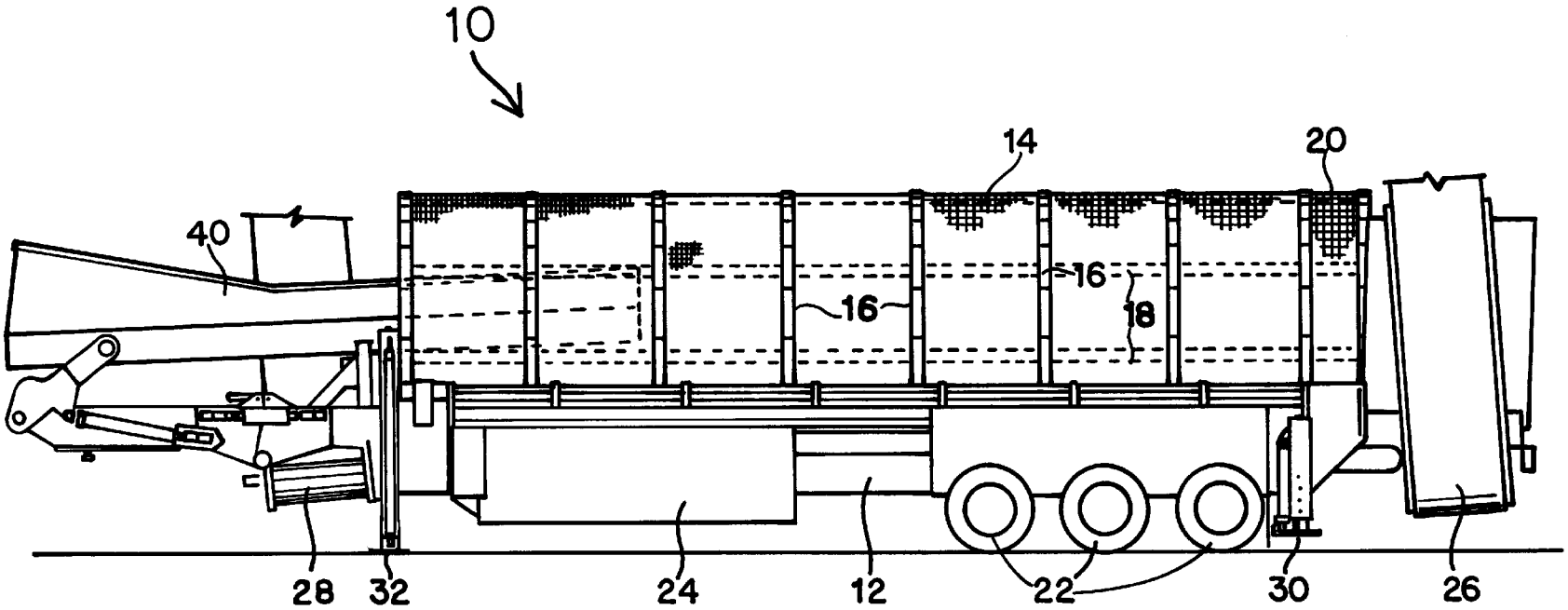
FIG. 1 is a representational side view of the transportable trommel assembly in a transport configuration.

Referring to FIG. 1, there is shown a sectional side view of the transportable trommel assembly 10 in the transport position, ready to receive a truck for purposes of being transported. Transportable trommel assembly 10 is formed of frame assembly 12, to which rotatable trommel screen assembly 14 is mounted. Rotating trommel screen assembly 14 is formed of longitudinal rails 18, and a series of spaced frame hoops 16, to which is attached trommel screen 20. As shown in FIG. 1, this is a two stage transportable trommel assembly, having two sieve sizes. Attached to frame assembly 12 are wheel and axle assemblies 22, and engine unit 24, which is used to rotate trommel screen assembly 14. A pair of rear stabilizer jacks 30 are provided, as well as a pair of front elevational jacks 32.

Not shown, but well known in the art with two stage trommel assemblies, are a pair of conveyors located beneath the trommel screen assembly 14 which operate in opposite directions, with the front conveyor transporting material from the smaller sieve size portion of trommel screen 20 to a front discharge conveyor 28, and a second conveyor located underneath the rear section of trommel screen assembly 14, which is used which is used to convey larger material to a rear discharge conveyor 26. In FIG. 1, both front conveyor 28 and rear conveyor 26 are shown in the transport position, in which they are thrice folded to wrap around the transportable trommel assembly 10, for purposes of transport. Triple folding conveyors are also well known in the art.

Figure 2:
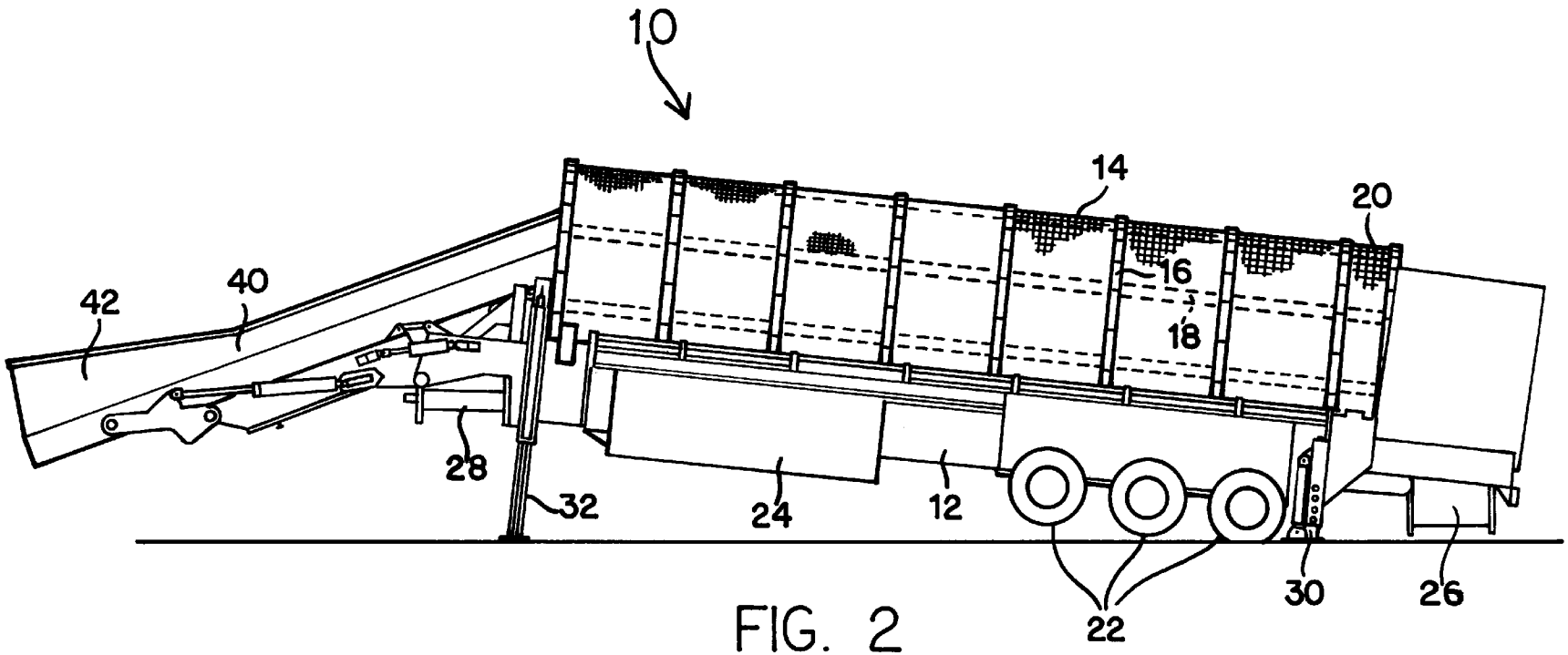
FIG. 2 is a representational side view of the transportable trommel assembly in an operating position.

In FIG. 2, both conveyors 26 and 28 are extended out and used to carry away sieved and segregated materials. All of this is well known in the art and plays no part of the present invention.

As can be seen in FIG. 2, front elevational jacks 32 are used to elevate the infeed end of trommel screen assembly 14, so that material will flow down through the trommel screen, with oversized material eventually dropping out the open back or discharge end. Rear stabilizer jacks 30 are used to level and hold the entire assembly in place, and infeed conveyor 40 is extended out and to a lowered position so that material to be sized and segregated can easily be dumped into load chute 42.

Figure 3:
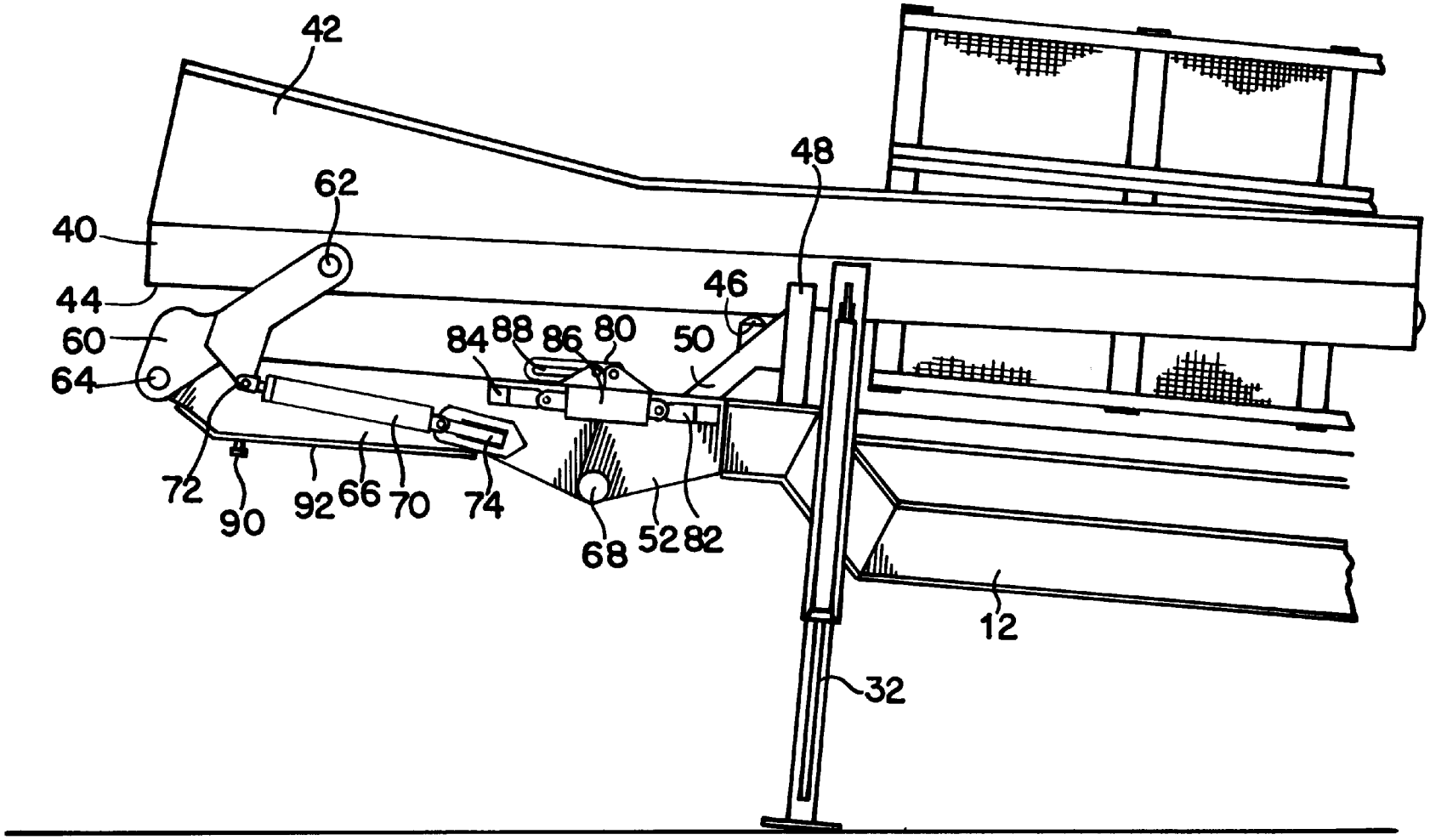
FIG. 3 is a sectional side view of the infeed conveyor assembly in the transport position.

Now referring to FIGS. 3 through 6, there is shown a more detailed view of the infeed conveyor assembly 40 as it is transitioned from the transport position to the lowered operating position. In FIG. 3, transport infeed conveyor 40 is shown resting in a cantilevered position. It is attached to frame assembly 12 by means of two pairs of pivot arms 60 and 66 and a frame piece extension 52, which connects to a pair of opposing infeed conveyor frame rails 44. The attachment point for infeed conveyor 40 is a pair of opposing frame rail pivot pins 62, which connect infeed conveyor frame rails 44 to the pair of extension pivot arms 60, which in FIG. 3 are shown in a fully retracted position, and in FIG. 4 in an intermediate extending position, and in FIG. 5, in a fully extended position. Extension pivot arms 60 are attached to lowering pivot arms 66 by means of second pivot pins 64. Lowering pivot arms 66 are interconnected to each other by means of bottom plate 92, from which extends trailer hitch 90, which is used to connect the transportable trommel assembly 10 to a transport truck, not shown. Frame rails 44 are not otherwise connected to trommel frame assembly 10 in any fashion other than the frame rails rest and ride atop infeed conveyor roller 46, which is supported by means of roller and guide bar frame 50. Also attached to roller and guide bar frame 50 are infeed conveyor side guide bars 48, which align and hold frame rails 44 in all of its positions. As can be seen in FIG. 3, the discharge end of infeed conveyor 40 is held in a cantilevered fashion inside trommel screen assembly 14 in the transport position.

Figure 4:
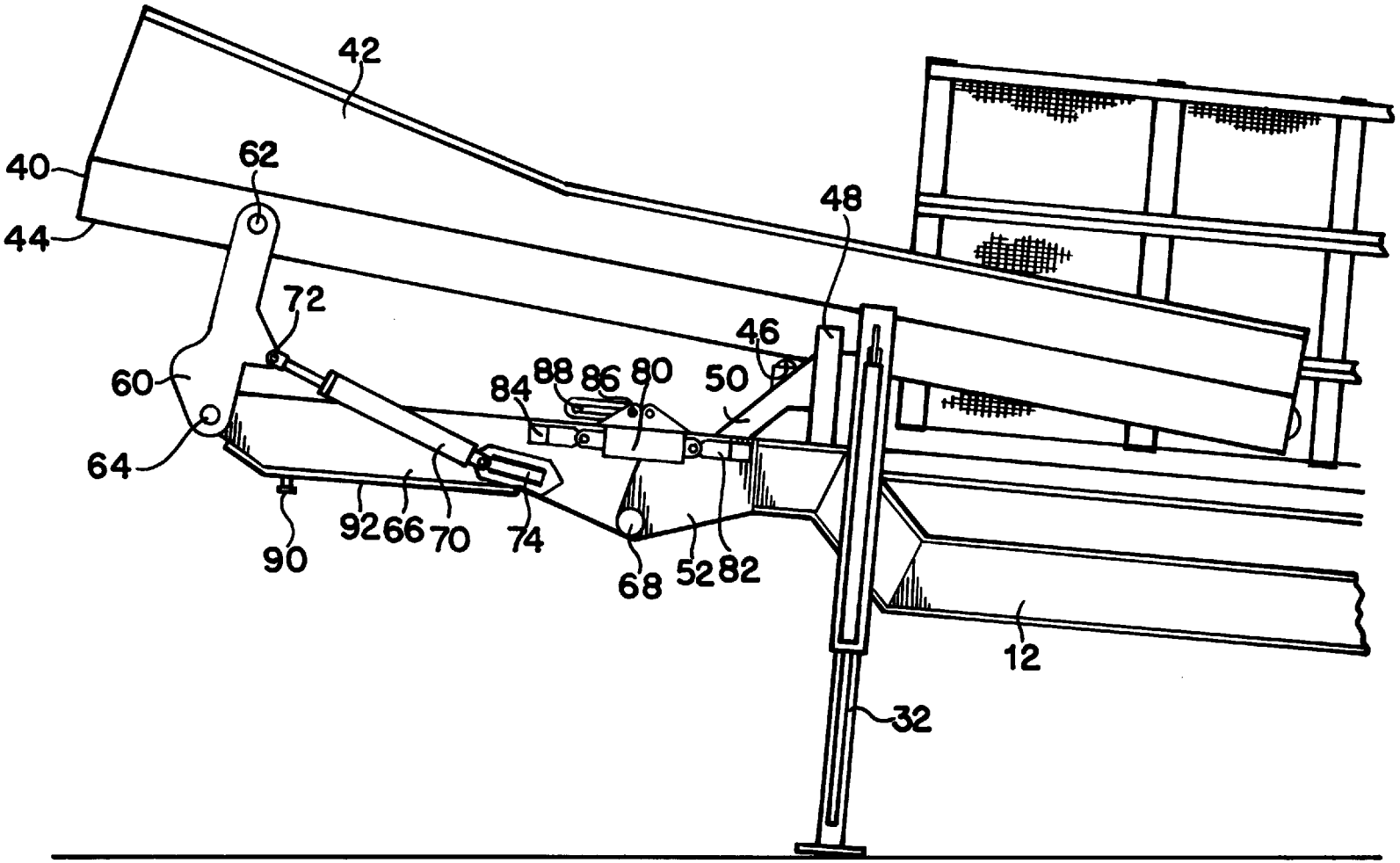
FIG. 4 is a sectional side view of the infeed conveyor assembly in a partially extended position.
Figure 5:
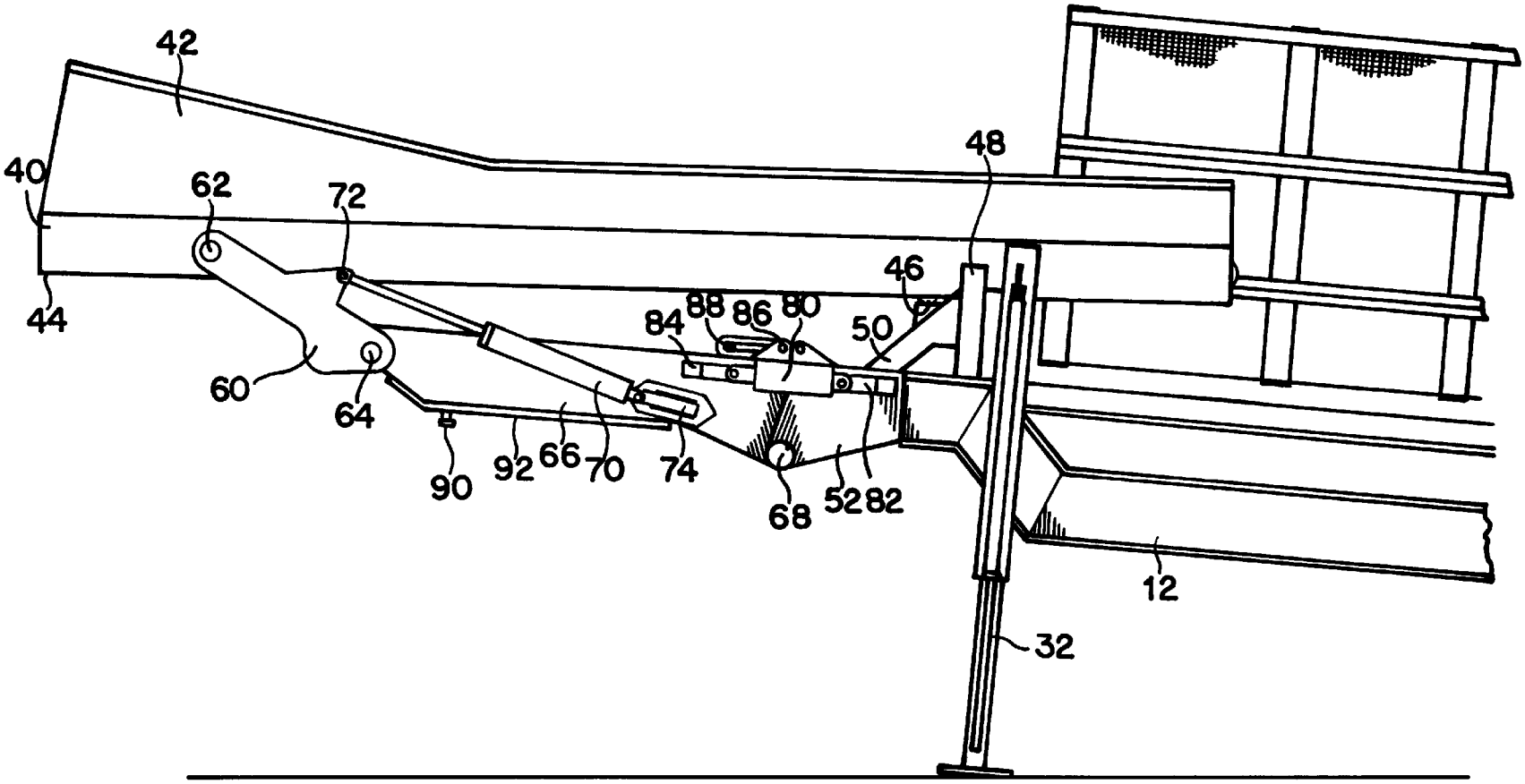
FIG. 5 is a sectional side view of the infeed conveyor assembly in an extended position.

Extension pivot arm 60 is rotated from its transport position as shown in FIG. 3 through the intermediate position shown in FIG. 4 to the fully extended position as shown in FIG. 5, by means of first hydraulic ram 70, which is attached to lowering pivot arm 66 by bracket 74, and to a pivot point 72 on extension arm 60. Conventional hydraulics are used to extend or retract dual action first hydraulic ram 70, to and from the retracted and the fully extended positions. As extension pivot arm 60 is rotated from the retracted to the extended position, and back again, frame rail pivot pin 62 rotates through an arc. Depending upon the length of infeed conveyor 40, and the diameter of trommel screen 14, it may be necessary to use the lowering pivot arm 66 to reduce the height of the arc so as to avoid contact between the discharge end of infeed conveyor 40 and trommel screen assembly 14.

Figure 6:
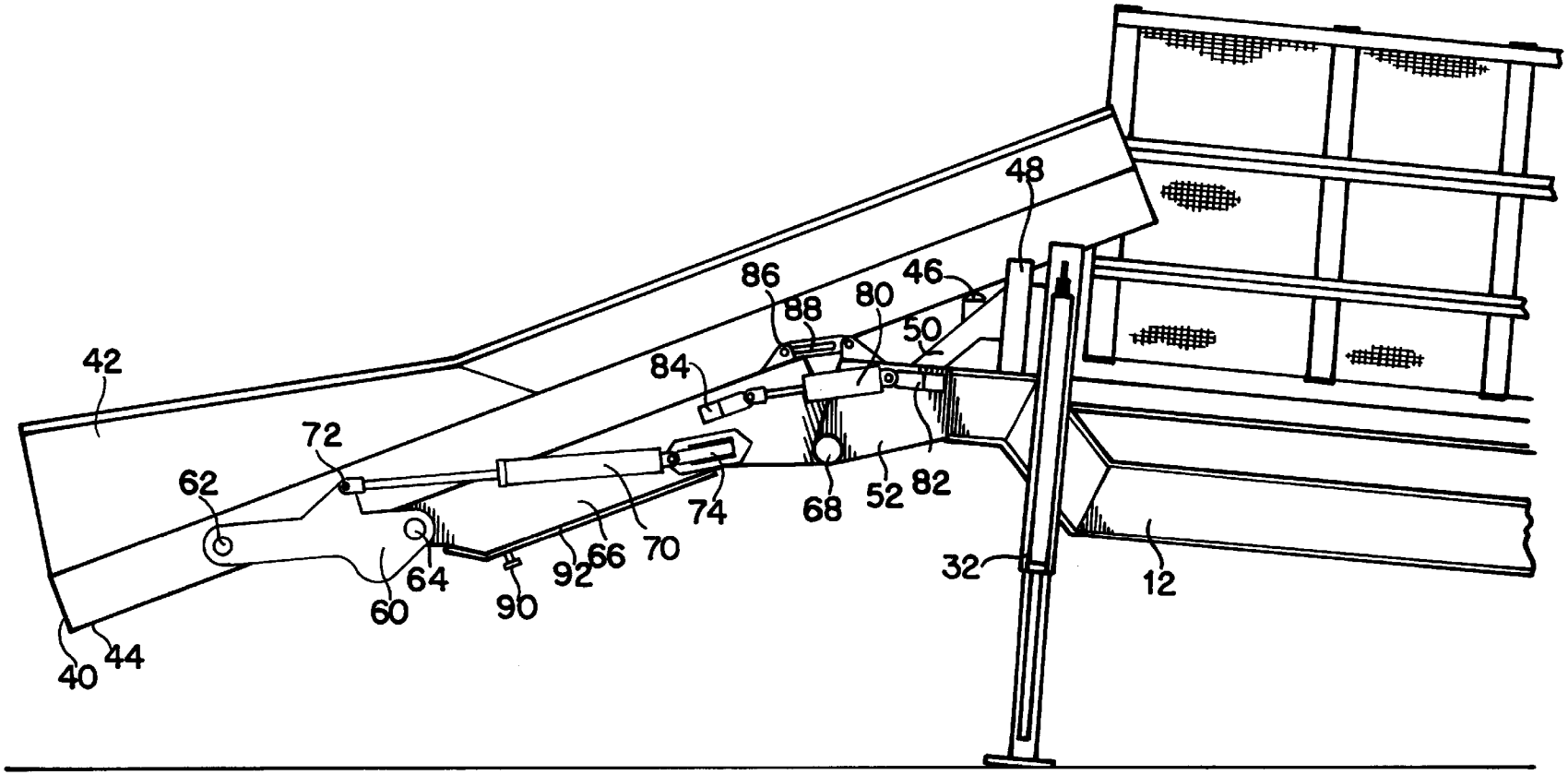
FIG. 6 is a sectional side view of the infeed conveyor assembly in a lowered and operating position.

The lowering function of lowering pivot arm 66 is shown in FIG. 6. As can be seen, lowering pivot arm 66 is pivotally attached to frame extension 52 by means of a pair of third pivot pins 68. Lowering ram 80 is provided, being attached to frame extension 52 by means of bracket 82, and to lowering pivot arm 66 by means of bracket 84. This, like the first hydraulic ram 70, is a dual action ram, and is used to lower and raise lowering pivot arm 66 to whatever the desired position is. Guide pin 86 is provided for lowering ram 80, and interfits within a slot in guide slot rail 88 to provide stability for the assembly.

In its lowered position, load chute 42 is considerably elevationally below the infeed section of trommel screen 14, in a position where it is convenient to use smaller, but faster, loading equipment to load the material to be sized and segregated into infeed conveyor 40.

To return the infeed conveyor 40 to its transport position from the operating position as shown in the operations described in FIGS. 3 through 6, are simply reversed.

In practice it has been found that with proper hydraulic systems, all of which are well known in the prior art, a single operator can disconnect a transport vehicle from the transportable trommel assembly 10, and set it up for use in less than thirty minutes. This represents a considerable savings in time and labor over the prior art.

While there is shown and described the present preferred embodiment of the invention, it is to be distinctly understood that this invention is not limited thereto but may be variously embodied to practice within the scope of the following claims.

I claim:

1. A transportable trommel assembly, for sizing material, which comprises:

a frame;

a cylindrical trommel screen, having a central longitudinal axis, an infeed end, and a discharge end, rotatably mounted to said frame;

means from rotating said trommel screen operatively connected to said trommel screen;

conveyor means for carrying away sized material from the trommel screen; and infeed means movably connected to said frame and positionable to an operating position for infeeding material to be sized into said infeed end of said trommel screen, and to a transport position within the infeed end of said trommel screen when said transportable trommel assembly is to be transported.

2. The transportable trommel assembly of claim 1 which further comprises means for selectively moving said infeed means between and to the operating position and the transport position attached to said frame and to said infeed means.

3. The transportable trommel assembly of claim 2 wherein said means for selectively moving said infeed means to the operating position and the transport position further comprises:

a hydraulically powered arm assembly attached to both said frame and said infeed means for extending out said infeed means from the transport position within said trommel screen to said operating position and for retracting said infeed means from the operating position to said transport position within said trommel screen.

4. The transportable trommel assembly of claim 1 wherein said infeed means further comprises a conveyor assembly having a loading end for receiving material to be sized and a discharge end for infeeding material into said trommel screen.

5. The transportable trommel assembly of claim 4 which further comprises means for lowering the discharge end of said conveyor assembly to a loading position below the infeed end of said trommel screen.

6. A transportable trommel assembly, for sizing material, which comprises:

a frame;

a cylindrical trommel screen, having a central longitudinal axis, an infeed end, and a discharge end, rotatably mounted to said frame;

means from rotating said trommel screen operatively connected to said trommel screen;

conveyor means for carrying away sized material from the trommel screen; and infeed means movably connected to said frame and positionable to an extended and lowered position for infeeding material to be sized into said infeed end of said trommel screen, and to a transport position within the infeed end of said trommel screen when said transportable trommel assembly is to be transported.

7. The transportable trommel assembly of claim 6 which further comprises:

means for extending and retracting the infeed means to, from and between said extended position and the transport position.

8. The transportable trommel assembly of claim 7 wherein said means for extending and retracting the infeed means to, from and between said extended position and the transport position further comprises:

an extension pivot arm pivotally connected to said frame and to said infeed means; and means for pivoting said extension pivot arm from a retracted position to and extended position.

9. The transportable trommel assembly of claim 8 which further comprises:

means for lowering and elevating the infeed means to, from and between said lowered position and the transport position.

10. The transportable trommel assembly of claim 9 wherein said means for lowering and elevating the infeed means to, from and between said lowered position and the transport position further comprises:

a lowering pivot arm pivotally connected to said frame and to said infeed means; and means for pivoting said lowering pivot arm from an elevated position to a lowered position.

11. The transportable trommel assembly of claim 6 which further comprises:

means for lowering and elevating the infeed means to, from and between said lowered position and the transport position.

12. The transportable trommel assembly of claim 11 wherein said means for lowering and elevating the infeed means to, from and between said lowered position and the transport position further comprises:

an lowering pivot arm pivotally connected to said frame and to said infeed means; and means for pivoting said lowering pivot arm from an elevated position to a lowered position.

13. A transportable trommel assembly, for sizing material, which comprises:

a frame;

a cylindrical trommel screen, said screen having a central longitudinal axis extending between an infeed end and a discharge end, said screen rotatably mounted to said frame;

means from rotating said trommel screen operatively connected to said trommel screen;

conveyor means for carrying away sized material from the trommel screen; and infeed means movably connected to said frame and positionable to an operating position for infeeding material to be sized into said infeed end of said trommel screen, and to a transport position within the infeed end of said trommel screen when said transportable trommel assembly is to be transported.

14. The transportable trommel assembly of claim 13 which further comprises means for selectively moving said infeed means between and to the operating position and the transport position attached to said frame and to said infeed means.

15. The transportable trommel assembly of claim 14 wherein said means for selectively moving said infeed means to the operating position and the transport position further comprises:

a hydraulically powered arm assembly attached to both said frame and said infeed means for extending out said infeed means from the transport position within said trommel screen to said operating position and for retracting said infeed means from the operating position to said transport position within said trommel screen.

16. The transportable trommel assembly of claim 13 wherein said infeed means further comprises a conveyor assembly having a loading end for receiving material to be sized and a discharge end for infeeding material into said trommel screen.

17. The transportable trommel assembly of claim 16 which further comprises means for lowering the discharge end of said conveyor assembly to a loading position below the infeed end of said trommel screen.

* * * * *